United States Patent [19]

Dilo

[11] Patent Number: 4,568,010

[45] Date of Patent: Feb. 4, 1986

[54] APPARATUS FOR AUTOMATICALLY SETTING NEEDLES IN NEEDLE BOARDS

[75] Inventor: Richard Dilo, Eberbach, Fed. Rep. of Germany

[73] Assignee: Oskar Dilo Maschinenfabrik KG, Eberbach, Fed. Rep. of Germany

[21] Appl. No.: 456,795

[22] Filed: Jan. 10, 1983

[30] Foreign Application Priority Data

Jan. 18, 1982 [DE] Fed. Rep. of Germany ..... 3201282

[51] Int. Cl.[4] ..... B27F 7/00

[52] U.S. Cl. ..... 227/120; 29/809; 29/810; 227/139

[58] Field of Search ..... 29/809, 810; 227/111, 227/110, 119, 120, 139, 124

[56] References Cited

U.S. PATENT DOCUMENTS

| | | | |
|---|---|---|---|
| 1,485,413 | 3/1924 | Johanson | 227/119 |
| 3,458,099 | 7/1969 | Schick | 227/111 |
| 3,771,709 | 11/1973 | Breschinsky | 227/120 |
| 3,833,991 | 9/1974 | Hehl | 29/809 X |
| 3,913,815 | 10/1975 | Holzer | 227/120 X |

*Primary Examiner*—Howard N. Goldberg

*Assistant Examiner*—Joseph M. Gorski

*Attorney, Agent, or Firm*—Yuter, Rosen & Dainow

[57] ABSTRACT

The invention refers to a method and apparatus for substantially automatically setting needles of needle boards of machines for the production of textile needle-felt webs, with needles of which the rear shaft end is bent by 90° to form an L-shaped head, wherein first of all the needles, oriented by ends, are filled into a container situated on the upper end of an inclined plane and subsequently, leaving the container individually through a slot in one container wall and lying parallel to each other, they slide on and then past a vibrating inclined plane, wherein the L-shaped heads on the ends of the needle shafts fall as a result of gravity into a gap along the inclined plane and along one lateral edge thereof, and the thus oriented needles slide at the lower end of the inclined plane into the hollow space of a magazine; upon the insertion of the magazine in the needle setting apparatus the needles are pushed in a direction opposite the direction of filling against a stop and guide plate and are pushed along this plate individually and consecutively into a bore in the needle board by means of a ram capable of being moved up and down.

12 Claims, 5 Drawing Figures

APPARATUS FOR AUTOMATICALLY SETTING NEEDLES IN NEEDLE BOARDS

BACKGROUND OF THE INVENTION

This invention refers to a method of automatically setting the needles of needle boards of machines for the production of textile needlefelt webs, with needles of which the rear shaft end is bent by 90° to form an L-shaped head, and to an apparatus for carrying out the method.

In needing technology, i.e. in the manufacture of non-woven textile webs from a wide variety of fibers, tools are used which necessarily have a very large number of needles attached to a needle board in a certain arrangement. These needle boards thus serve as needle carriers which are moved back and forth relative to the fiber fleece during the work such that the needles penetrate the fiber fleece and are withdrawn therefrom. The needles have a reinforced shaft with which they are inserted into a bore in the needle board. The fit is selected such that the needles are frictionally clamped fast in the bores. It is not at all unusual for needle boards of a needle machine to have 20,000 needles per meter of working width. There are machines with a working width of up to 6.5 meters, which means that the needle boards of such machines are equipped with up to 130,000 needles. As a result of heavy wear, the life of the needles varies according to the fibrous textile material processed; frequently, such needles must be replaced after an operative life of as little as 100 hours.

As a rule, the setting and removal of needles in the needle board is done by hand with a considerable expenditure of time and personnel. Herein, the needles are inserted individually into the bores in the needle boards and are then driven in completely with a hammer. Of course apparatus are already being used in which a compressed air activated ram with a correspondingly wide head pushes a number of needles into the bores after their insertion by hand, so that the step of driving them in with the hammer is eliminated; however, these apparatus were unable to prove themselves due to their totally insufficient degree of automation.

SUMMARY OF THE INVENTION

The task of the invention is to automate as far as possible the setting of needles in the needle boards, in order to avoid the tedious, monotonous and time-consuming manual work and thus to make needle boards more quickly available for operation, so that a certain reserve of needle boards can be spared as well.

For the solution of the aforementioned task it is proposed that a method of automatic needling of needle boards of needlefelt machines be developed such that the end-oriented needles are first of all filled into a container vibrating in different directions and situated at the upper end of an inclined plane, from which container they exit individually one after the other through a slot and, lying parallel to each other, they slide onto and then past an inclined vibrating plane, wherein the L-shaped heads at the ends of the shafts fall due to gravitational pull into a gap along the inclined plane and along the one lateral edge thereof, and that furthermore, the so oriented needles slide at the lower end of the inclined plane into a magazine, from which, after the magazine is inserted in the needle setting apparatus, they are pressed against a stop and guide plate in a direction opposite the direction of filling and are individually and consecutively pushed axially by means of a reciprocating ram into a bore in the needle board, which can be advanced stepwise, wherein the L-shaped heads of all needles lie in the same direction. The aforegiven method enables a most extensive automatic needling of the needle boards with thousands of needles within an extremely short time.

The above described method for solving the task can be modified in that the aligned needles, lying side by side, are not—as shown above—filled into a special magazine in which they are each arranged individually and with which they are inserted in the needle setting apparatus, but rather they are bound together in the aforementioned position to form a stack. For this purpose the needles are first of all temporarily filled into a magazine in the same manner described above, but they are bound together in this magazine by means of at least one adhesive strip or an adhesive varnish, so that they can be removed from the aforementioned magazine.

The so-formed stack made up of a plurality of parallel needles can then be inserted into a magazine or a feed shaft situated in the needle setting apparatus. If the needles of the needle stack are bound by means of one or more adhesive strips, they are then released from the adhesive strip or strips. The foremost needle each is pushed, by a feeding force acting upon the needle stack, against a stop and guide plate of the needle setting apparatus and from there is pushed into a bore in the needle board by means of a ram moving up and down, as mentioned above.

An apparatus consisting essentially of two parts serves to carry out the method in question. The first part of the apparatus serves the execution of the first part of the method steps and comprises a slide plate suspended in a frame so as to enable vibration, said slide plate being downwardly inclined and capable of being vibrated in different directions. Above the upper end of this slide plate a supply container to hold the needles is provided, having in its front side wall a needle exit slot parallel to and directly above the slide plate and capable of being being regulated with respect to height. Next to the one edge of the slide plate and the adjacent side of the frame a gap corresponding to the thickness of the L-shaped heads of the needles is provided; at the lower end of the slide plate an exchangeable needle magazine is situated on the same plane as that of the slide plate, so that the needles sliding over the slide plate can slide into the needle magazine through the opening therein. The needle magazine consists essentially of two parallel plates in which the needles lie parallel and adjacent to each other, wherein the L-shaped heads always assume a position at right angles to the plates.

The second part of the apparatus, serving to conduct the second part of the method steps, comprises a means for positioning and pushing in the needles, this means being mounted on a carriage capable of being moved over the needle board to be equipped with needles and having a stop and guide plate to which the needle magazine can be exchangeably attached and along which a ram for pushing in the needles can be moved up and down.

BRIEF DESCRIPTION OF THE DRAWINGS

Details and additional features of the apparatus designed according to the invention can be found in the claims and in the following description of a particularly preferred embodiment illustrated in FIGS. 1–4 of the drawings.

DETAILED DESCRIPTION OF THE DRAWINGS

Figure 1:
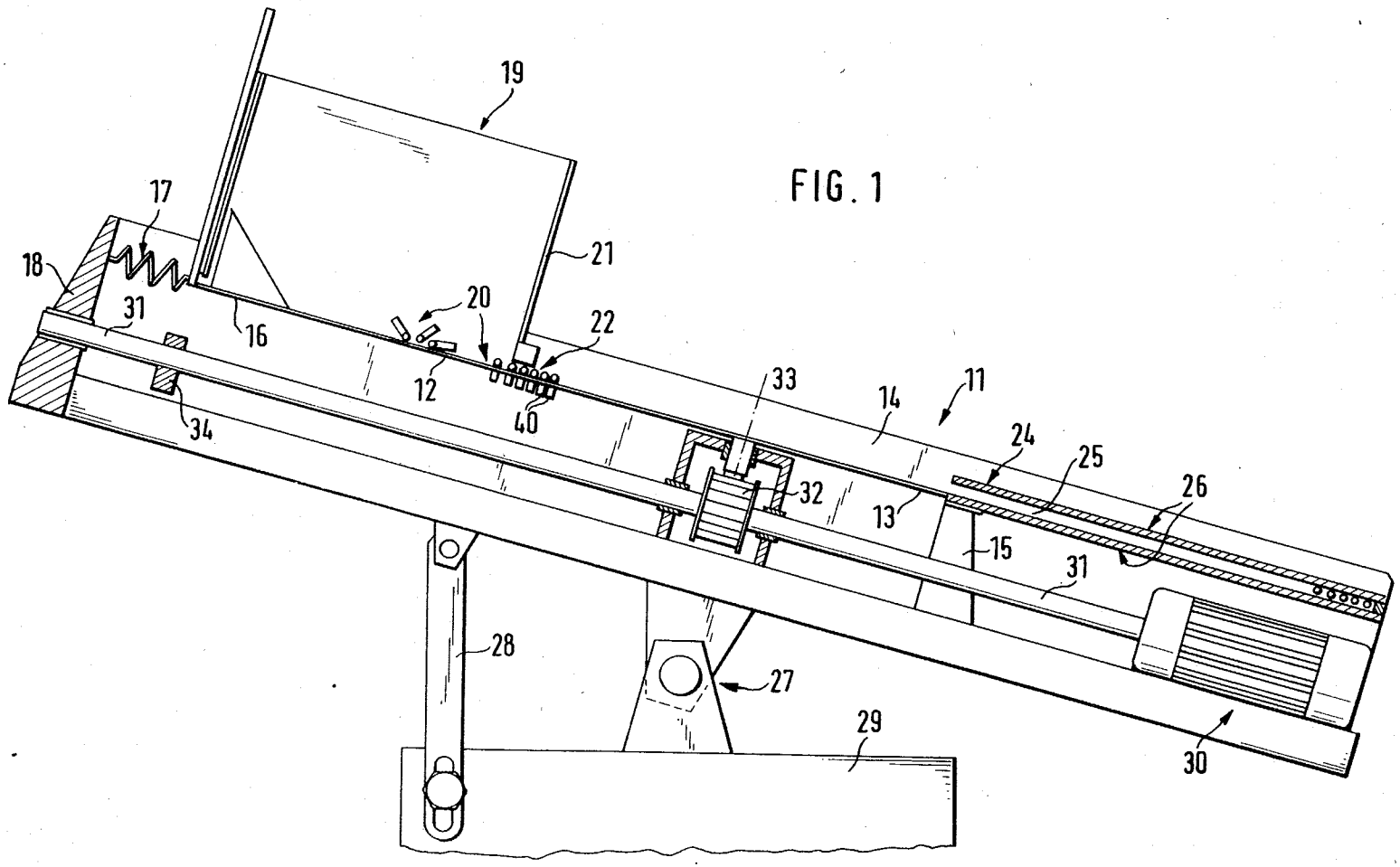
FIG. 1 shows a longitudinal section through the magazine loading apparatus.

As seen in FIG. 1, the magazine loading apparatus for carrying out the first part of the steps according to the method of the invention consists of a frame 11 in which a slide plate 12 is attached with its lower end 13 to a yoke 15 mounted between the two side pieces 14. The rear end 16 of the slide plate 12 is connected to the rear frame piece 18 by means of a tension spring 17. Above the rear end 16 of the slide plate 12 a supply container 19 is provided to hold the needles 20 to be separated, aligned and filled into a magazine, with said container being attached to the frame 11. At the lower end of the front wall 21, directly above the slide plate 12, an exit slot 22 is located for the needles 20 sliding on the downwardly inclined slide plate 12.

At the lower end 23 of the frame 11 holders are provided for the needle magazine 24, which can be inserted in the frame 11 in extension of the slide plate 12, so that the needles 20 can slide from the slide plate 12 directly into the flat hollow space 25 between the two parallel plates 26 forming the magazine 24.

The frame 11 is secured to a base plate 29 by means of a joint 27 and a support 28 with adjustable height; the desired angle of inclination of the slide plate 12 can be set by means of the adjustable support 28.

In order to remove the needles 20 from the supply container 19 and to slide them downward over the inclined slide plate 12, said slide plate is caused to vibrate in various directions. Beneath the slide plate 12 a shaft 31 rotated by a driver motor 30 is provided in the frame 11, on which shaft a gear 32 is situated, the teeth of which cause a ram 33 connected with the slide plate 12 to vibrate in an axial direction. A roller abutting the outer periphery of the gear can be provided at the lower end of the ram 33.

In order to guarantee a continuous removal of the needles 20 from the supply container 19, the rear end 16 of the slide plate 12 is further put into torsional vibration. For this purpose an eccentric or cam disc 34 is provided on the shaft 31, which disc swings the pivoting rod 36 connected with the slide plate 12 back and forth via the lever mechanism 35 and thereby twists the slide plate 12 on its longitudinal axis 37 first in one direction and then in the other.

Figure 2:
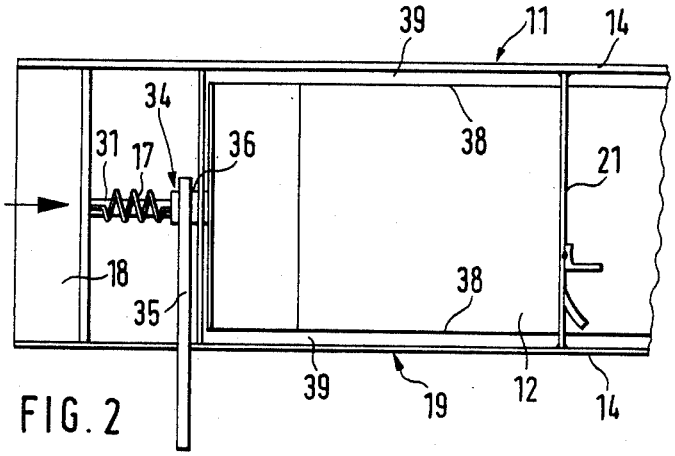
FIG. 2 shows a view from above of the magazine loading apparatus according to FIG. 1.
Figure 3:
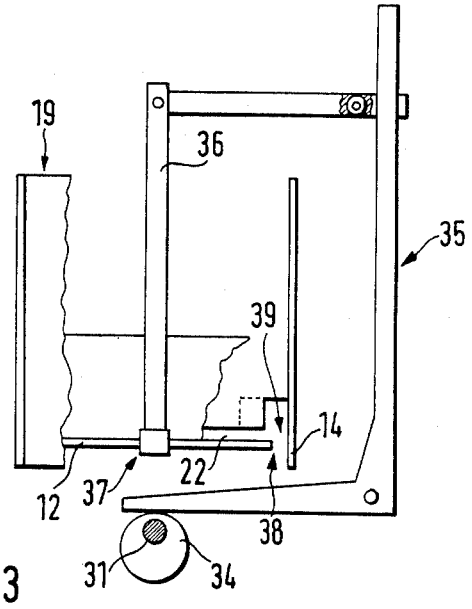
FIG. 3 shows a cross section through the rear end of the magazine loading apparatus according to FIG. 1

As seen particularly in FIG. 2, a gap 39 is provided between the edges 38 of the slide plate and the lateral pieces 14 of the frame 11, into which gap the L-shaped heads 40 of the needles lying perpendicular to the longitudinal axis 37 on the slide plate 12 fall as a result of the force of gravity, so that they hang vertically downward. In this manner the needles are oriented exactly in the same way during the sliding advancement over the slide plate 12.

Figure 4:
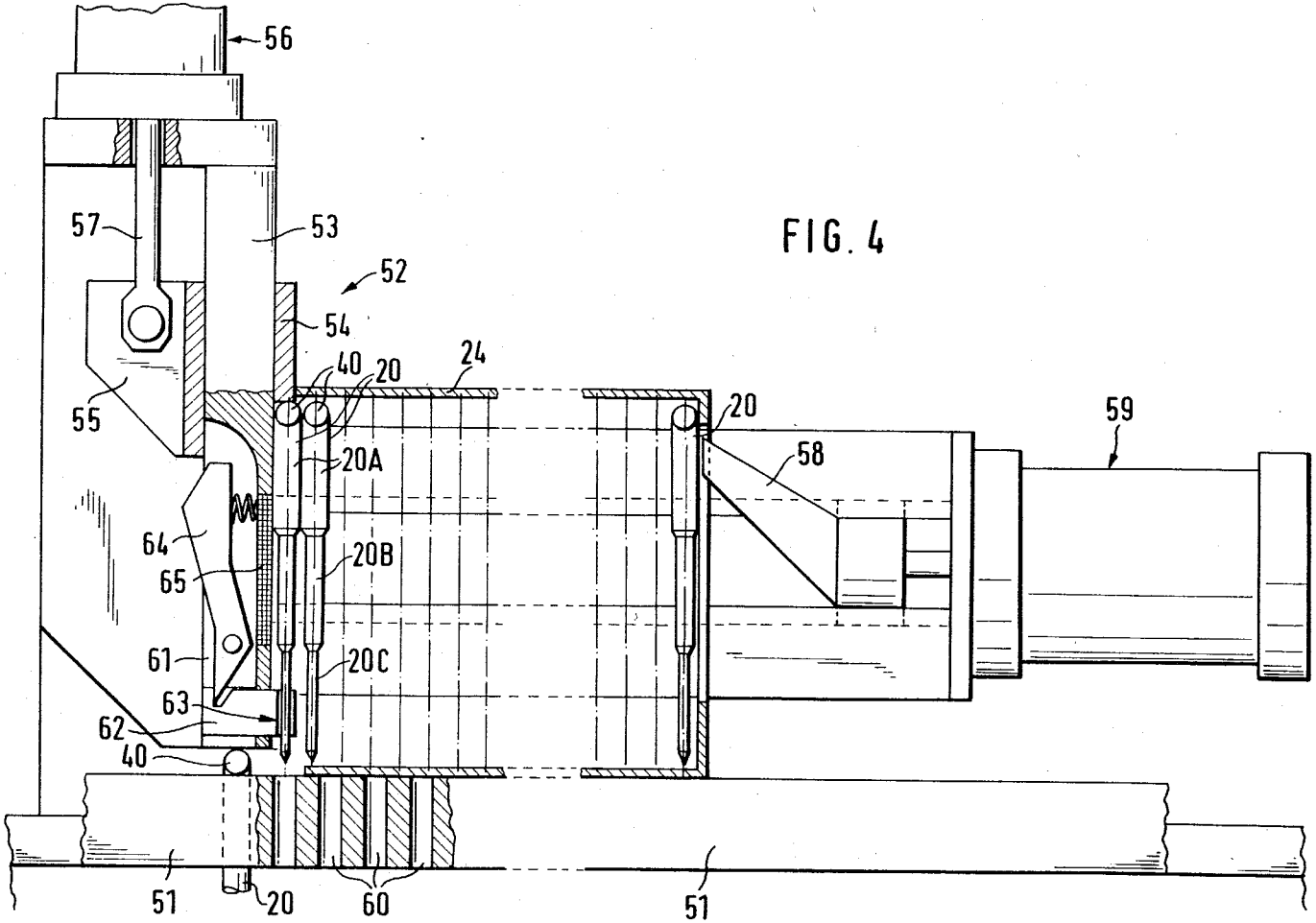
FIG. 4 shows a longitudinal section through the needle setting apparatus.

When the hollow space 25 of a needle magazine 24 is filled with needles 20, the full magazine 24 is exchanged for an empty one and the full magazine is attached to the needle setting apparatus shown in FIG. 4, by means of which the second part of the steps of the method according to the invention is carried out.

The needle setting apparatus is mounted on a carriage not shown in detail, which is movable over the needle board 51 to be equipped with needles 20. The apparatus is provided with a needle positioning and ramming device 52, with said device having a stop and guide plate 53 to which the needle magazine 24 with the needles 20 can be exchangeably attached, wherein the foremost needles 20 in the needle magazine 24 abut the guide plate 53 with their reinforced shaft **20*a*, along which guide plate a needle pushing ram 54 can be slidingly moved up and down. The needle pushing ram 54 is seated on a sled 55 running along the stop and guide plate 53 and driven by a lifting rod 57 moved up and down by a drive motor 56. In order that each foremost needle 20 in the needle magazine 24 abuts the stop and guide plate 53, the needles are pressed against the stop and guide plate 53 by means of an advancement ram 58 acting upon the hindmost needle 20. The advancement ram 58 can either be acted upon by a spring or driven by a hydraulic or pneumatic cylinder 59**.

Since the needles 20 have a reinforced shaft **20*a*, a narrowed middle piece 20*b* relative thereto, and a further narrowed end 20*c*, it is necessary to guide the forward end 20*c* of the needles 20 exactly while the tip of the needle enters the bore 60 in the needle board 51. A positioning slide bar 62 situated at the lower end 61 of the stop and guide plate 53 and mounted at right angles to the needles 20 so as to be reciprocally movable relative thereto, serves to guide the forward end 20*c* of the needles 20. This positioning slide bar 62 is provided at the end facing the magazine 24 with a stop surface, in particular a notch 63, on the inclined surfaces of which the needle 20 abuts with its forward end 20*c*. In order that the positioning slide bar 62 is not in the way of the reinforced middle part 20*b* and particularly of the hind shaft part 20*a* upon the further downward movement of the needles 20, the slide bar is withdrawn from the path of the needles 20 upon the downward movement of the sled 55 by means of a tipping lever 64 pivotably mounted on the stop and guide plate 53. In order that the needle always abuts the stop and guide plate 53 in the desired position and is held with its axis parallel to the same, a magnet 65 is provided therein, the magnetic field of which acts on the needle 20** which is foremost at that time.

Figure 5:
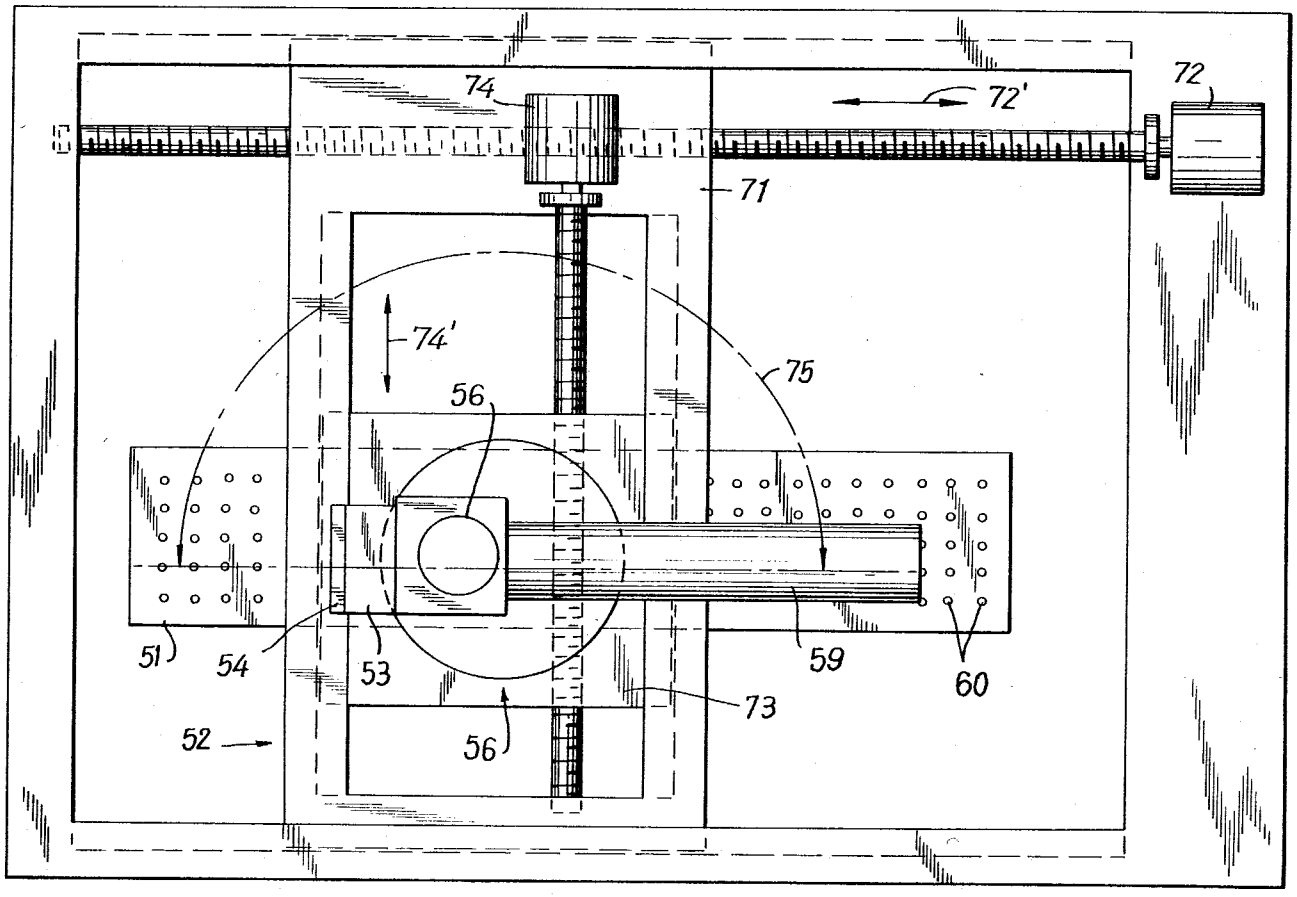
FIG. 5 shows a plan view of the needle setting apparatus of FIG. 4.

As FIG. 5 shows, the needle setting apparatus 52 is pivotable around its vertical axis. It is also movable in the longitudinal directions 72' of the needle board by means of a first sled 71 with a first spindle drive 72, and in the transverse directions 74' by means of a second sled 73 with a second spindle driver 74, so that the needle setting apparatus 52 can be positioned by a numerically controlled drive means such that a selected hole 60 in the needle board 51 can be filled automatically by a needle, wherein the L-shaped heads 40 of all needles 20 point in the same direction, which is important in certain cases. By the pivotability of the needle setting apparatus around its vertical axis in the directions of the arrows 75, it is also possible to give the heads 40 of the needles 20 a specific angular position relative to the longitudinal axis of the needle board.

In the needle setting apparatus described above, the needles arranged lying adjacent to each other are located in a magazine which is inserted in the needle setting apparatus. If the adjacently lying needles are bound together to form a stack of needles, for example by means of an adhesive varnish or preferably by means of at least one adhesive strip, then these needle stacks are inserted into a magazine or a feed shaft of the needle setting apparatus. In order to be able to remove the adhesive strip holding the needles together, openings through which the adhesive strips can be removed from the needles are provided in the side walls of the magazine or feed shaft. This can be done manually or mechanically. In the event that the needles are held together by adhesive varnish, removing the same is superfluous, as the force exerted on the downwardly movable ram is so great that the foremost needle acted upon by the ram is easily shorn away from the following needle, particularly as the adhesive varnish layer is very thin anyway.

What is claimed is:

1. An apparatus for setting elongated needles in needle boards of machines for manufacture of textile needle felt webs, each needle having a shaft-like upper end portion of a first cross sectional area, with an uppermost end of each needle being bent to form an L-shaped head, and further having a lower end portion of a second cross sectional area, said lower end portion being intermediate said upper end portion and a needle point, said second cross sectional area being smaller than said first cross sectional area, each of said needle boards having a plurality of holes and one of said needle boards resting on a base, said needle points being spaced by a gap from said one of said needle boards, said apparatus and base being movable relative to each other, comprising:

feed means for containing one row of closely packed, aligned, contacting but unconnected needles with all of said needle points directed toward said base;

a housing structure;

stop means fixed to said housing structure, said feed means being positioned adjacently said stop means with the upper end portion of a first needle at one end of said row of needles abutting said stop means, the lower end portion of said first needle at said one end of said row being offset from said stop means, said stop means orienting said upper end portions transversely to said base;

needle pushing means for pressing against said L-shaped head to move said first needle toward said base, said needle pushing means being reciprocally movable from a first position which is immediately above said first needle, to a second position which causes said first needle to be pushed across said gap and into said needle board, and back to said first position; said stop means being positioned to guide said pushing means;

means for advancing said row of needles towards said stop means, upon insertion of said first needle of said row of needles into a hole in needle board by said forward and return movements of said needle pushing means from its second position to its first position, the needle immediately following said first needle of said row of needles being urged by said means for advancing against said stop means, whereby said needle immediately following said first needle in said row is positioned as a first needle subject to insertion in said needle board said means for advancing acting in a direction perpendicular to a lengthwise direction of the needles and acting upon a last needle at the other end of said row of needles and forcing said upper end portion of said first needle against said stop means;

needle positioning means for prevention of needle tilting while said needles are held against said stop means, for positioning said needle with said lower end portion aligned for entry of said point to a selected hole in said needle board, and being provided with at least one positioning surface facing said needles, said at least one positioning surface acting on the smaller lower end portion of said first needle of said row of needles, said needle positioning means being reciprocally movable from an initial position in which said positioning surface abuts said lower end portion of said first needle to a withdrawn position, and then back to said initial position, said at least one positioning surface moving in a direction perpendicular to said lengthwise direction of the needles;

drive means for moving said needle positioning means from its first position to said withdrawn position, said withdrawn position being achieved before said shaft-like upper end portion of said first needle reaches said needle positioning means during insertion by said needle pushing means of said first needle into said selected hole of said needle board.

2. An apparatus for setting needles as claimed in claim 1, wherein said drive means for said needle positioning means is mechanically coupled to said needle positioning means, said drive means biased by a force working thereon to a first position corresponding to said initial position of said needle positioning means, said drive means being movable against said force from its first position to a second position corresponding to said withdrawn position of said needle positioning means.

3. An apparatus for setting needles as claimed in claim 1, and further comprising control means for moving said drive means from its first position to its second position during movement of said needle pushing means from its first position to its second position, and on return of said needle pushing means allowing return of said drive means to its first position, said control means being mechanically connected to said needle pushing means.

4. An apparatus as claimed in claim 3, wherein said drive means is a tipping lever pivotably mounted on said housing structure, one end of said tipping lever being mechanically coupled to said needle positioning means, another end of said tipping lever being spring loaded to provide said biasing force and projecting into the path of said control means, said control means running on a surface of said another end of said tipping lever and moving said tipping lever against said biasing force of said spring from said first position of said second position of said drive means.

5. An apparatus as claimed in claim 1 or 4, wherein said stop means is a plate, serving also as a guide for said needle pushing means.

6. An apparatus as claimed in claims 1 or 4, and further comprising a magnet, said magnet being included in said stop means to magnetically hold said upper end portion of said first needle of said row of needles against said stop means.

7. An apparatus as claimed in claims 1 or 4, and further comprising numerically controlled drive means for moving said apparatus relative to said needle board, and a first sled connected with a first spindle drive, and a second sled slidably mounted on said first sled and connected to a second spindle drive, said first and second sleds moving at right angles one to the other in response to said numerically controlled drive means, any hole in said needle board being subject to automatic selection for insertion of a needle.

8. An apparatus as claimed in claim 7, wherein said numerically controlled drive means provides for rotation of said apparatus around an axis perpendicular to said base, rotation of said apparatus allowing orientation of said L-shaped heads of said needles in any selected direction relative to said base.

9. An apparatus as claimed in claims 1 or 4, and further comprising numerically controlled drive means for moving said apparatus around an axis perpendicular to said base, said L-shaped heads of said needles being subject to orientation in any angular direction relative to said base by rotation of said apparatus.

10. An apparatus as claimed in claims 1 or 4, wherein said needle feed means is a replaceable magazine.

11. An apparatus as claimed in claim 10, wherein the needles of said row of needles are interconnected by one of at least one adhesive strip and an adhesive varnish.

12. An apparatus as claimed in claims 1 or 4, wherein the needles in said row of needles are interconnected by one of at least one adhesive strip and an adhesive varnish.

* * * * *

UNITED STATES PATENT AND TRADEMARK OFFICE

CERTIFICATE OF CORRECTION

PATENT NO. : 4,568,010

DATED : February 4, 1986

INVENTOR(S) : Richard Dilo

It is certified that error appears in the above-identified patent and that said Letters Patent is hereby corrected as shown below:

Column 1, line 12, change "needing" to --needling--.

Column 3, line 45, change "driver" to --drive--.

Signed and Sealed this

*Twenty-third* Day of *September 1986*

[SEAL]

*Attest:*

DONALD J. QUIGG

*Attesting Officer*

*Commissioner of Patents and Trademarks*